US007436278B2

(12) United States Patent
Fischer et al.

(10) Patent No.: US 7,436,278 B2
(45) Date of Patent: Oct. 14, 2008

(54) ELECTRICAL CONTACTING OF THIN ENAMELED WIRES OF SECONDARY WINDINGS OF IGNITION COILS HAVING A CONTACT CROWN AND CONTACT ELEMENT

(75) Inventors: Bernd Fischer, Sulzberg (DE); Klaus Lerchenmueller, Immenstadt (DE); Konstantin Lindenthal, Blaichach (DE); Thomas Breckle, Bihlerdorf (DE); Juergen Raedler, Burgberg (DE); Werner Steinberger, Immenstadt (DE)

(73) Assignee: Robert Bosch GmbH, Stuttgart (DE)

( * ) Notice: Subject to any disclaimer, the term of this patent is extended or adjusted under 35 U.S.C. 154(b) by 4 days.

(21) Appl. No.: 10/586,884

(22) PCT Filed: Dec. 13, 2004

(86) PCT No.: PCT/EP2004/053410

§ 371 (c)(1),
(2), (4) Date: May 25, 2007

(87) PCT Pub. No.: WO2005/071700

PCT Pub. Date: Aug. 4, 2005

(65) Prior Publication Data

US 2007/0216507 A1 Sep. 20, 2007

(30) Foreign Application Priority Data

Jan. 21, 2004 (DE) ..... 10 2004 002 935

(51) Int. Cl.
*H01F 27/02* (2006.01)
*H01F 38/12* (2006.01)

(52) U.S. Cl. ..... 336/92; 336/96

(58) Field of Classification Search ..... 336/90, 336/92, 96; 123/634–635
See application file for complete search history.

(56) References Cited

U.S. PATENT DOCUMENTS

| | | | | |
|---|---|---|---|---|
| 4,962,361 | A | 10/1990 | Ida et al. | |
| 5,225,801 | A | 7/1993 | Ida et al. | |
| 6,094,122 | A * | 7/2000 | Sexton | 336/96 |
| 6,747,540 | B1 * | 6/2004 | Nakase et al. | 336/192 |
| 6,836,203 | B2 * | 12/2004 | Wada | 336/198 |
| 2002/0158740 | A1 * | 10/2002 | Paul et al. | 336/96 |

FOREIGN PATENT DOCUMENTS

| | | |
|---|---|---|
| FR | 2 716 938 | 9/1995 |
| WO | 98 01873 | 1/1998 |

* cited by examiner

*Primary Examiner*—Anh T Mai
(74) *Attorney, Agent, or Firm*—Kenyon & Kenyon LLP

(57) ABSTRACT

An electrical connection set-up for connecting thin enameled wires in ignition coils, which is to replace thermal methods, for example. This is achieved in that, to produce contacting between the winding and the respective high-voltage or low-voltage outlets, an individual contact element able to be slid over the winding by its one side and is fixed in place via its other side, the contact element having a spring-type design, a sliding surface, and at least on its one side fans out in a tulip-shape in the sliding direction, in such a way that the contact element presses against the winding in a spring-like manner in the mounted state and the insulation layer is ruptured and electrical contacting takes place.

6 Claims, 5 Drawing Sheets

ELECTRICAL CONTACTING OF THIN ENAMELED WIRES OF SECONDARY WINDINGS OF IGNITION COILS HAVING A CONTACT CROWN AND CONTACT ELEMENT

FIELD OF THE INVENTION

The present invention relates to an electrical connection setup for manufacturing an ignition coil, particularly a rod-type ignition coil having a coil shell with a high-voltage outlet as well as a low-voltage outlet.

BACKGROUND INFORMATION

Ignition coils produce high-voltage sparks. This spark flashes over between the electrodes of the spark plug set up at the ignition coil, thus igniting the air-gasoline mixture of an internal combustion engine, for example. Normally, this spark plug having an ignition coil is supplied with high voltage. A primary winding and a corresponding secondary winding are provided within the ignition coil. At one end, the primary winding is coupled to an ignition and starting switch, while its other end is connected to a so-called contact breaker.

The secondary winding, that is, the winding responsible for generating the ignition spark, is connected in the interior of the ignition coil to the one end of the primary winding, so that it is grounded. The other end of the secondary winding is connected to the high-voltage outlet, which in turn is connected either to an ignition cable leading to the spark plug, or at which the spark plug is set up directly.

The secondary winding itself is made up of a thin wire which is coated with a suitable layer of enamel so as to avoid the contacting of the individual wires when wrapping the coil shell. Once the secondary windings have been wound onto the coil shell, the ends of the individual wires are contacted. Normally, thermal contacting methods such as soldering or welding, for example, are known for this purpose.

Different work processes are required especially with regard to the contacting of the primary and secondary windings. This entails higher installation costs, multiple assembly steps and also a certain number of connecting parts necessary to make an appropriate electrical connection.

Furthermore, in such a very tight installation space, it was often difficult to bring about an appropriate contacting using the known thermal methods.

SUMMARY OF THE INVENTION

It is the objective of the present invention to produce a connection setup in a secondary or primary winding which is implementable in an inexpensive and simple manner.

The basic principle for achieving the objective is to replace the thermal contacting method known per se from the related art. This is achieved by providing additional contacting elements that rupture the enamel-coated wire of the secondary winding during installation and thus bring about an appropriate contacting.

Compared to the previous method, the "cold" contacting method provided here has the advantage that it involves no additional installation costs. In addition, the system of the present invention makes it possible to reduce the number of assembly steps and also the number of connecting parts.

A further important advantage of the present invention is that the implementation of the contacting does not require the installation space to be optimized. This means that it will not be necessary to reserve free space in the area of contacting, e.g. for electrode holders, soldering irons or the like.

According to the present invention it is provided that a contact element is inserted on the side of the low-voltage outlet via guidance means. The contact element is designed such that the one end fans out in a tulip shape in the sliding direction and in this manner slides over the primary winding situated on the coil shell during the sliding operation. The other end is designed such that it is able to be fixed in position in a pocket.

For better sliding characteristics, the contact element additionally has a sliding surface pointing toward the primary winding.

By placing a primary coil shell over at least a portion of the secondary coil shell, the free end of the contact element with its sliding surface is pressed down by a lip which is situated within the primary coil shell.

Once a defined position has been reached, the contact element with its sliding surface presses against the insulation-coated wires of the secondary coil shell, which causes the insulation to rupture at the corresponding contact points, thus allowing an electrical contact to be established between the individual wires of the secondary coil shell and the contact element.

The contact element is preferably designed such that it has a waist to achieve its mechanical spring-type characteristics.

On the side of the high-voltage outlet, in particular, the contact elements configured according to the present invention are combined in the form of a contact crown. The individual contact elements according to the present invention are fixed in place on a ring element on their side facing away from the sliding surface. This contact crown is preferably a one-piece component it being conceivable that the contact crown is able to be produced in a single working process (punching and bending).

When the contact crown is slipped over the secondary windings, the individual contact elements slide on the surface of the winding. The tulip-shaped design of the contact crown prevents displacement of or damage to the windings. A limit stop, which simultaneously accommodates the end of the secondary winding in the form of a tie-up post, defines the position of the contact crown. This is also attributable the fact that the diameter of the contact crown is larger than the secondary coil shell plus two times the diameter of the secondary winding.

In a further step, a ring element is slipped over the contact crown, by which a press fit of the contact element on the secondary winding, and thus a contacting of the contact elements of the contact crown with the secondary winding, is achieved.

DETAILED DESCRIPTION

Figure 1:
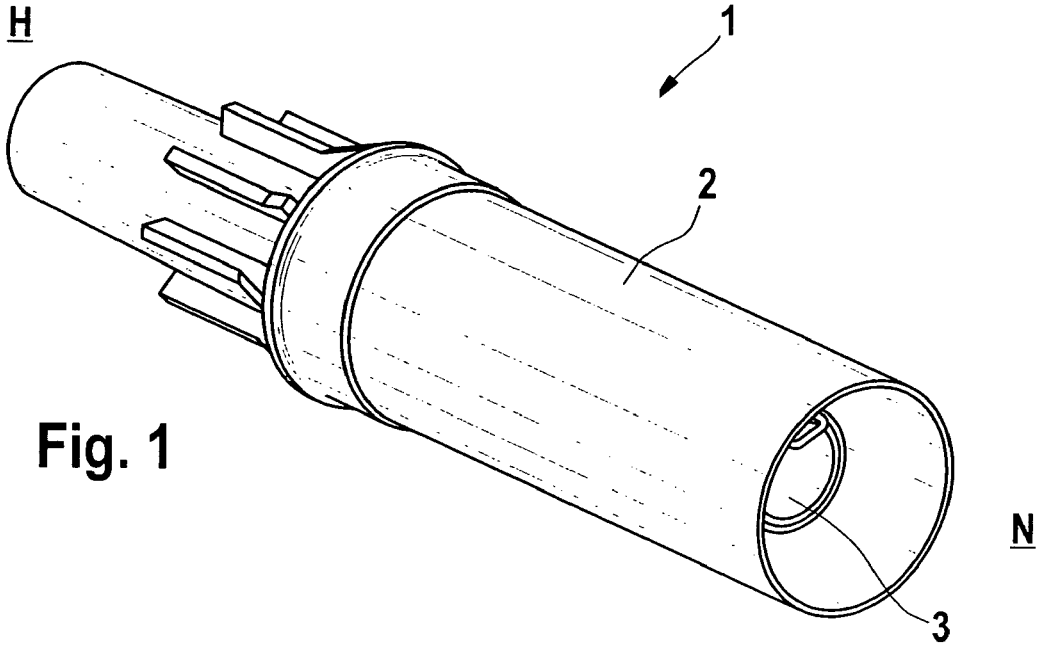
FIG. 1 shows a perspective view of an ignition coil having one side for the high-voltage outlet and another side for the low-voltage outlet.

FIG. 1 shows a perspective view of an ignition coil 1. Ignition coil 1 includes an ignition coil housing 2 and a secondary coil shell 3 located in ignition coil housing 2. In addition, ignition coil 1 features a side for a high-voltage outlet H and a side for low-voltage outlet N. The side of low-voltage outlet N is provided to establish contact with a power supply not detailed in the drawing, while the side of high-voltage outlet H is provided for connecting to an ignition cable or a spark plug not detailed in the drawing.

Figure 2:
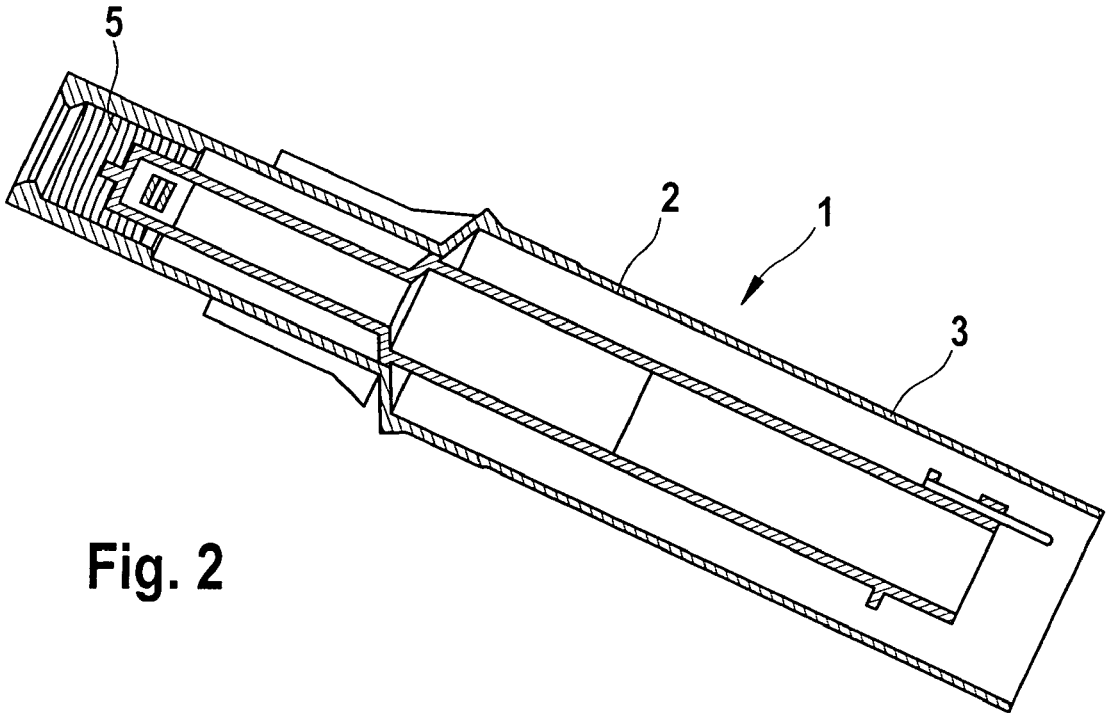
FIG. 2 shows a sectional view through the ignition coil according to FIG. 1.

FIG. 2 shows a sectional view of ignition coil 1 illustrated in FIG. 1; the areas shown relate to essential features of the present invention which are shown in greater detail in the subsequent figures.

Figure 3:
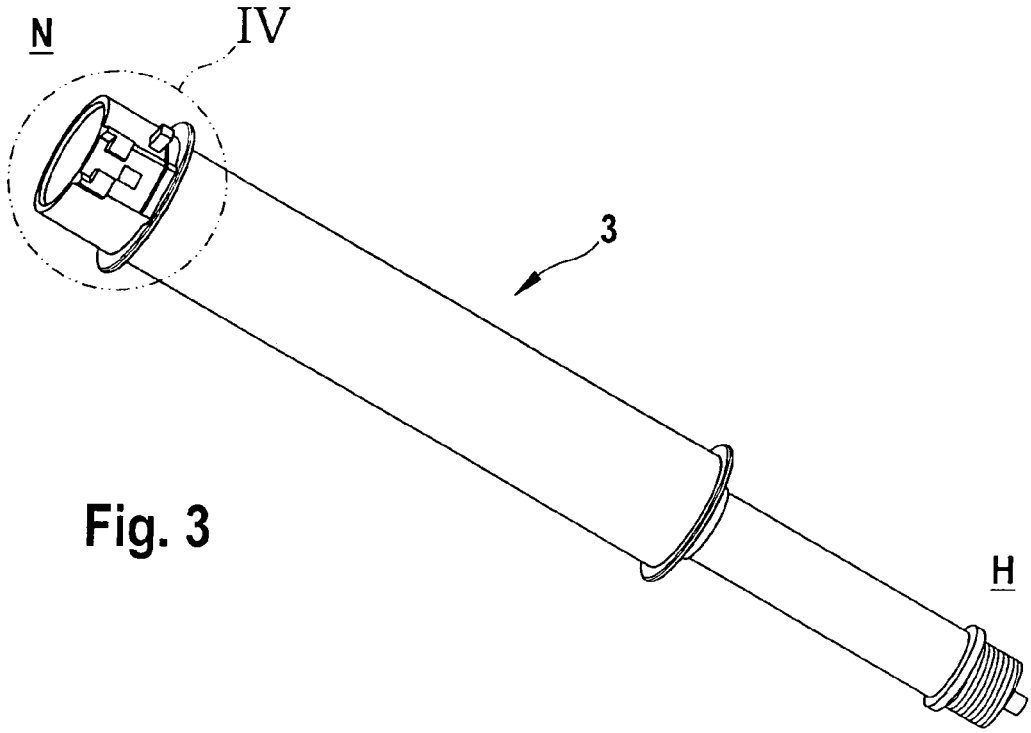
FIG. 3 shows a perspective view of a secondary coil shell, which is situated in the ignition coil housing shown in FIG. 1.

FIG. 3 shows ignition coil rod 3 with one side for high-voltage outlet H and one side for low-voltage-outlet N, which, immediately following its assembly, is able to be inserted as a unit into ignition coil housing 2 illustrated in FIGS. 1 and 2.

Side of Low-Voltage Outlet N

Figure 4:
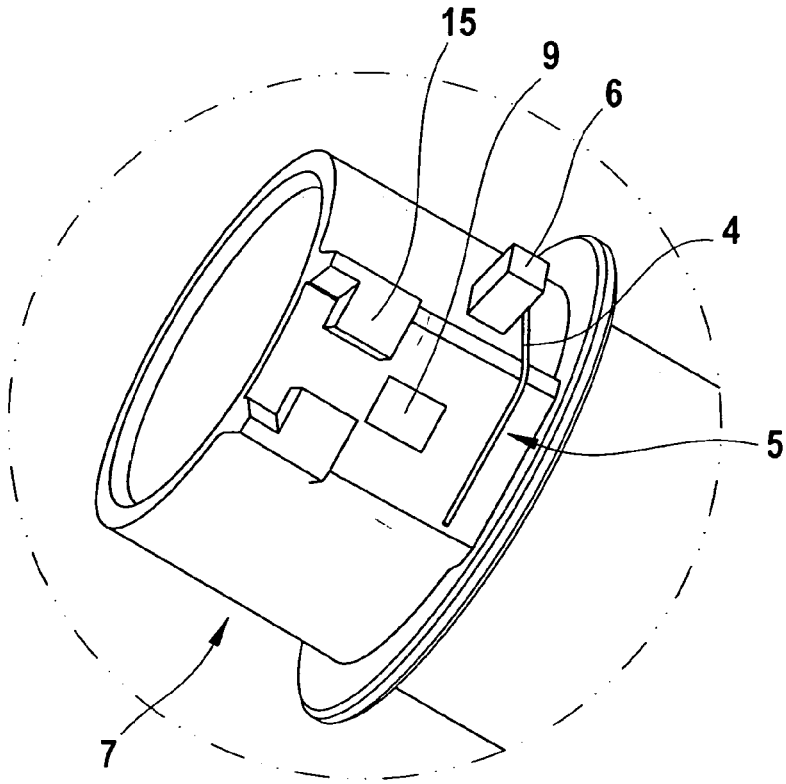
FIG. 4 shows a perspective view of the side of the low-voltage outlet of the secondary coil shell.

FIG. 4 shows an enlarged representation of the side of low-voltage outlet N of a secondary coil shell 3. It is provided to wind a wire 4 onto secondary coil shell 3, so that winding 5 provided here results. One end of wire 4 of winding 5 is attached to a so-called tie-up post 6 from which wire 4 is wound onto the peripheral surface of secondary coil shell 3 and extends over a defined contact area. This contact area at the same time serves as contacting area 7 for a contact element 8, shown in the additional figures, for establishing an electrical contact between winding 5 and contact element 8 itself.

Figure 5:
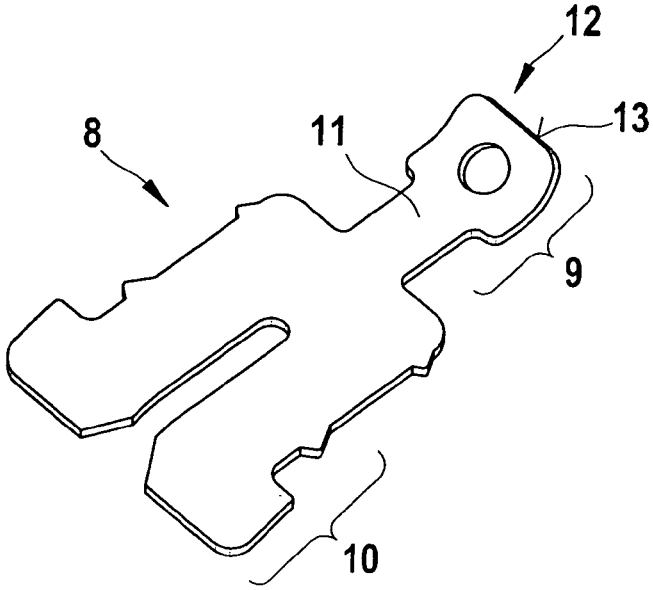
FIG. 5 shows a perspective view of a contact element according to the present invention.

FIG. 5 shows contact element 8 according to the present invention. It is formed in one piece and essentially made up of two regions, i.e., a contact region 9 and a fixation region 10, the two regions being separated from one another by a waist 11. Contact element 8 fans out in the shape of a tulip in contact region 9, and it has on its one side 12 a sliding surface 13 which slides over contacting area 7 of winding 5 during installation of contact element 8.

Figure 6:
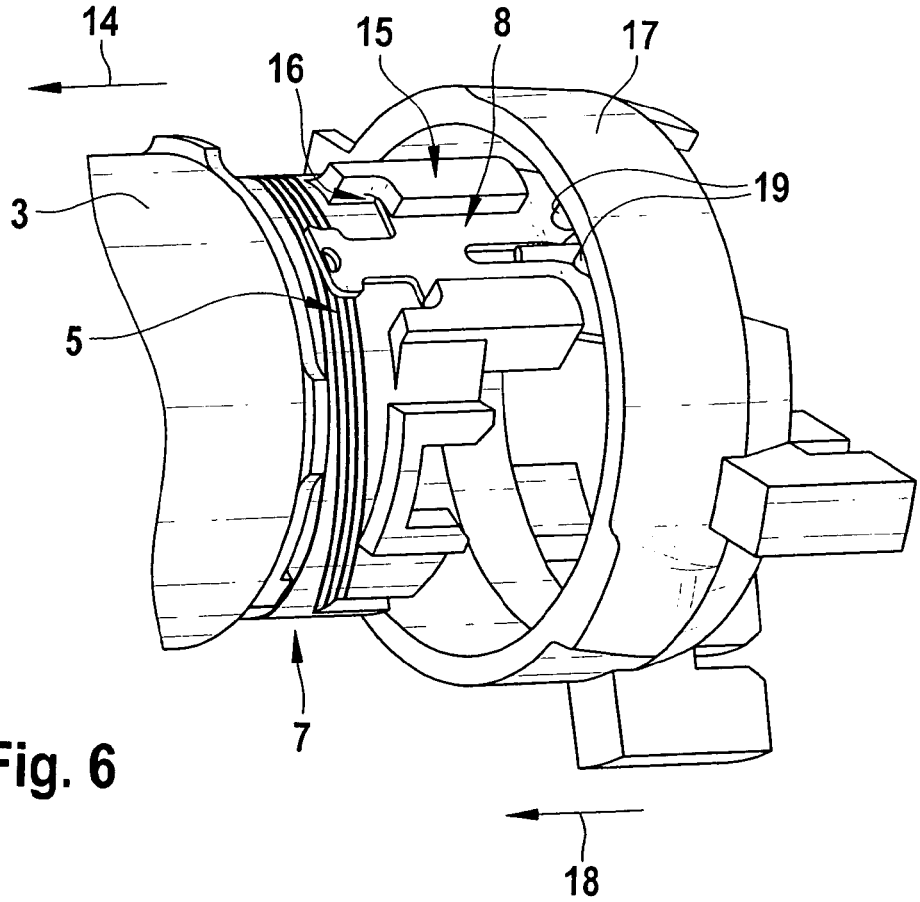
FIG. 6 shows a perspective view of the side of the low-voltage outlet of the ignition coil rod having the contact element of the present invention, according to FIG. 5.
Figure 7:
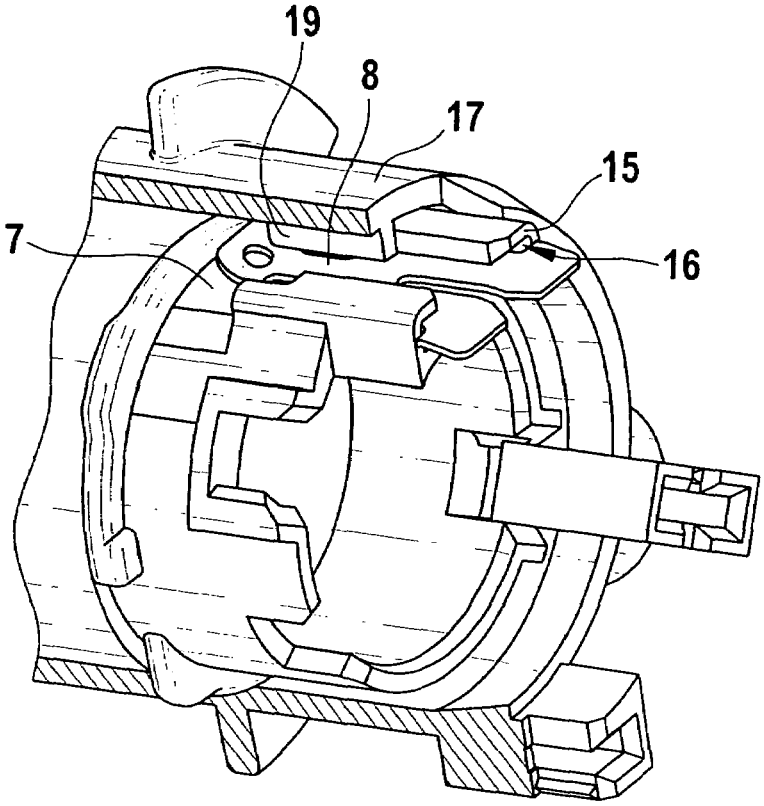
FIG. 7 shows another perspective view of the side of the low-voltage outlet of the secondary coil shell having the contact element of the present invention, according to FIG. 5, but without the secondary winding being shown.

Once winding 5 (FIGS. 6 and 7) has been produced on secondary coil shell 3, contacting area 7 is completely covered by winding 5. Subsequently, contact element 8 is slid in the direction of arrow 14 according to FIG. 6, into guide means 15 situated on secondary coil shell 3. In the process, contact element 8 slides along contacting area 7 of winding 5 until it is fixed in place in pocket-type form 16 of guide means 15. In an additional step, a primary coil shell 17 is slipped over in the direction of arrow 18. In the installed state of primary coil shell 17, lips 19, which are in the form of anvils and situated inside primary coil shell 17, press one side onto winding 5 and cause the insulation layer of wire 4 of winding 5 to rupture. In this way an electrical connection has been established without the use of a thermal method.

Side of High-Voltage Outlet H

Figure 8:
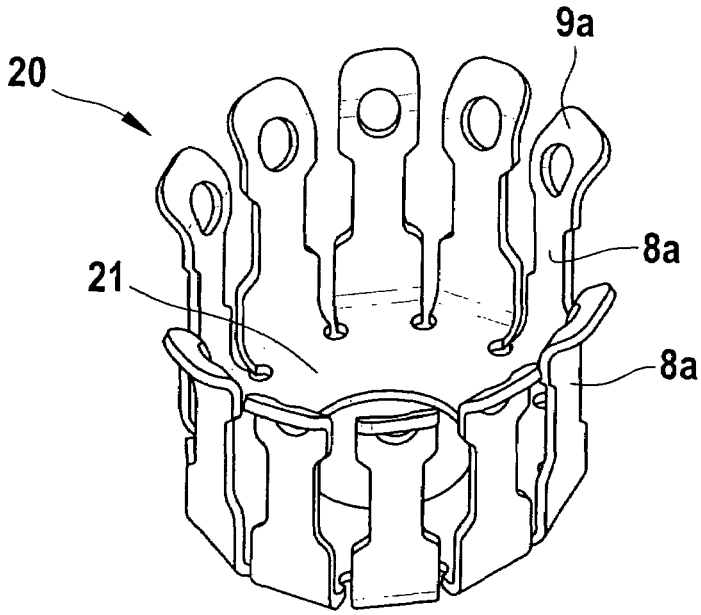
FIG. 8 shows a perspective view of a contact crown according to the present invention, essentially made up of the contact elements according to FIG. 7.

In another development, FIG. 8 shows a contact crown 20, which is made up of a plurality of contact elements 8*a* that are mounted on a ring element 21. In the exemplary embodiment shown here, contact crown 20 has been formed in one piece. Individual contact elements 8*a* of contact crown 20 fan out in the form of a tulip in the direction of their contact regions 9*a*.

Figure 9:
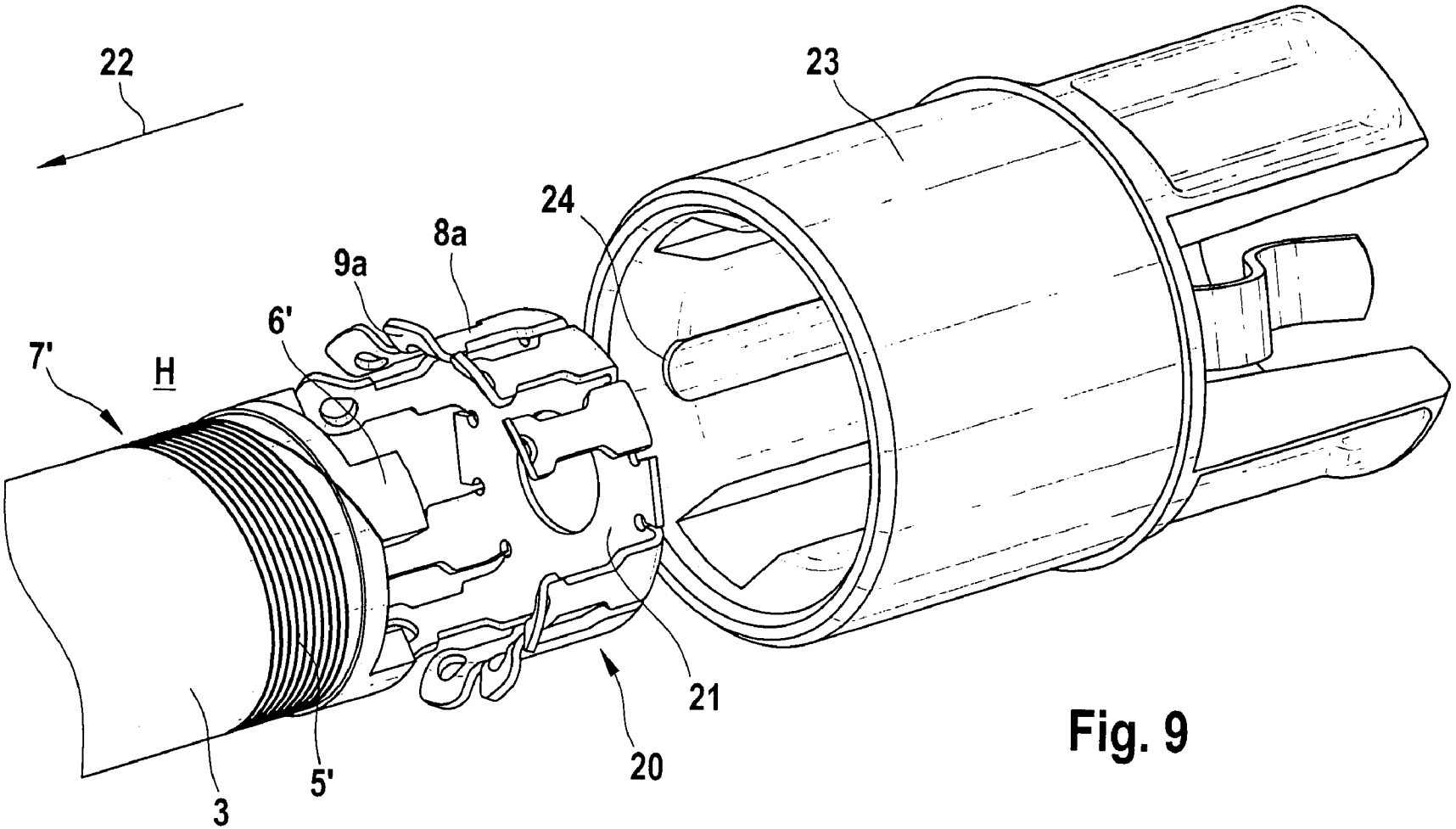
FIG. 9 shows a perspective view of the side of the high-voltage outlet of the secondary coil shell with the contact crown of the present invention according to FIG. 8 being shown.

To install contact crown 20 according to FIG. 8 on secondary coil shell 3 (FIG. 9), cup-shaped contact crown 20 is slid onto the region of high-voltage outlet H in the direction of arrow 22 until ring element 21 has reached a tie-up post 6'. This type of design of a limit stop is used to produce a correctly implemented position of contact crown 20 with respect to contacting area 7' or 9*a* of winding 5' or contact elements 8*a*.

Sliding a ring element 23 able to be contacted via a spark plug in the direction of arrow 22 causes contact regions 9*a* of individual contact elements 8*a* to be pressed against winding 5' in its contacting area 7' since lips 24 are also provided inside ring element 23, which press them against winding 5' in the installed state and thereby establish electrical contacting by rupturing the insulation.

What is claimed is:

1. An electrical contacting of thin enameled wires in an ignition coil having a coil shell and provided with a high-voltage outlet and a low-voltage outlet, comprising:

a contacting area;

a contact element;

a wire that is wound onto the ignition coil and that is connectable in the contacting area with the contact element, the contact element destroying an enamel layer of the wire when contacting the wire, wherein:

the contact element is connectable to the coil shell, a contact region of the contact element is able to slide over the wire in the contacting area, and during installation of the ignition coil the contact region cooperates with a coil element that is able to be slipped over the contact element and presses the contact region against the wire in the process to destroy the enamel layer of the wire.

2. The electrical contacting as recited in claim 1, wherein the ignition coil includes a rod-type ignition coil.

3. The electrical contacting as recited in claim 1, wherein:

the contact element includes a fixation region that is able to be connected to the coil shell, and the contact region forms an angle out of a plane of the fixation region, away from the contacting area.

4. The electrical contacting as recited in claim 3, wherein the coil shell includes a pocket-type receptacle for the fixation region.

5. The electrical contacting as recited in claim 1, wherein the coil element includes at least one lip for a defined generation of a contact pressure of the contact element on the wire.

6. The electrical contacting as recited in claim 1, further comprising:

a ring element; and a plurality of further contact elements combined to form a contact crown, the further contact elements being disposed on the ring element.

* * * * *